United States Patent [19]

Larikka

[11] 4,412,441

[45] Nov. 1, 1983

[54] METHOD FOR FORMING AN ENLARGED FLANGED HOLE IN A CURVED SURFACE

[75] Inventor: Leo Larikka, Vaasa, Finland

[73] Assignee: G. A. Serlachius Oy, Mantta, Finland

[21] Appl. No.: 419,126

[22] Filed: Sep. 17, 1982

Related U.S. Application Data

[62] Division of Ser. No. 226,869, Jan. 21, 1981.

[30] Foreign Application Priority Data

Jan. 30, 1980 [FI] Finland ..... 800278

[51] Int. Cl.[3] ..... B21D 21/00; B21D 53/00; B23B 35/00

[52] U.S. Cl. ..... 72/71; 72/325; 72/340; 408/1 R; 29/157 T

[58] Field of Search ..... 72/70–72, 72/367, 325, 340, 117; 29/157 T; 408/1 R, 92, 224, 225

[56] References Cited

U.S. PATENT DOCUMENTS

| | | | |
|---|---|---|---|
| 3,151,657 | 10/1964 | Beranek | 29/157 T |
| 3,711,214 | 1/1973 | Cloutier | 408/92 |
| 3,910,094 | 10/1975 | Luttgert et al. | 29/157 T |
| 4,083,219 | 4/1978 | Combes | 29/157 T |
| 4,248,555 | 2/1981 | Satou | 408/225 |
| 4,307,593 | 12/1981 | Riggs | 72/125 |

FOREIGN PATENT DOCUMENTS

| | | | |
|---|---|---|---|
| 973917 | 7/1960 | Fed. Rep. of Germany | 29/157 T |
| 40-14851 | 7/1965 | Japan | 29/157 T |

*Primary Examiner*—Lowell A. Larson
*Attorney, Agent, or Firm*—Mason, Kolehmainen, Rathburn & Wyss

[57] ABSTRACT

A method useful for forming in a curved surface, an enlarged hole surrounded by an upturned flange whose unattached edge lies substantially in a common plane, uses a drill rod, a set of bits, and a mechanism for forming an upturned flange. A first bit attached to the lower end of the rod forms an initial hole. A second bit, spaced axially along the rod, forms a widened oval hole with tapered sides upon continued axial and rotary movement of the rod relative to the workpiece. A flange forming mechanism is then extended beneath the edge region of the hole and pulled through the hole while rotating, to form the upturned flange. A third bit mounted peripherally with respect to the second bit is used to smooth and level the flange edge and to provide it with a desired shape.

4 Claims, 3 Drawing Figures

METHOD FOR FORMING AN ENLARGED FLANGED HOLE IN A CURVED SURFACE

This application is a division of copending application Ser. No. 226,869, filed Jan. 21, 1981.

FIELD OF THE INVENTION

The present invention relates to a flange forming drill means for drilling a hole in a pipe or a like wall and for forming a flange or collar around the hole, said means comprising a drill rod to be mounted on a rotating machine and forming means connected to the rod, whereby said forming means can, after the hole has been drilled, be extended below the hole edges by turning an adjusting means turnably mounted around the drill rod.

BACKGROUND ART

A flange forming drill means for forming a hole in a pipe with an upturned peripheral flange is disclosed in the U.S. Pat. No. 3,592,038. This apparatus has proved to be very useful whenever it is necessary to make a flanged hole in the side of a pipe, e.g. for connecting a branch pipe.

SUMMARY OF THE INVENTION

An object of the present invention is to provide drill means capable of making flanges of large diameter in a curved pipe wall, so that the edges of a finished flange lie substantially in a common plane.

For this object, the flange forming drill means of the invention is characterized in that a first drill bit for drilling the initial hole is fitted to the lower end of said drill rod and that a second bit for completing the drilling comprises bit elements secured to a bit body on the opposite sides of said rod to which, on the other hand, said body is secured, the cutting edges of said bit elements extending obliquely upwards and away from the drill rod. Thus, the drilling of a hole is effected in two steps. The first step comprises drilling of an initial hole, circular in plan view, by means of the first bit extending through the wall. Thereafter, the hole is expanded by means of a bit whose cutting edges form a rotational pattern of a truncated cone. When drilling a curved pipe wall with such a bit, the hole will be elliptical in plan view, the major axis of said hole being parallel to the longitudinal axis of the pipe to be drilled. With the up-lifting of the flange effected thereafter by the forming means, the hole edges can be brought to a substantially common level as the elliptical shape of the hole compensates for curvature of the pipe.

To be able to finish the flange with the same drill means, a third bit comprises, in order to level the edge face of the flange, bit elements secured to the bit body and disposed, with respect to the drilling axis, on an outer radius than bit elements of the second bit. Thus, the bit elements of the third bit are aligned with the rim of the flange lifted up by the forming means and, with the help of said elements, the end edge of the flange can be levelled into desired shape.

BRIEF DESCRIPTION OF THE DRAWING

In the following, one embodiment of the invention is described in more detail with reference being made to the accompanying drawings, in which.

DETAILED DESCRIPTION OF THE PREFERRED EMBODIMENT

Figure 1:
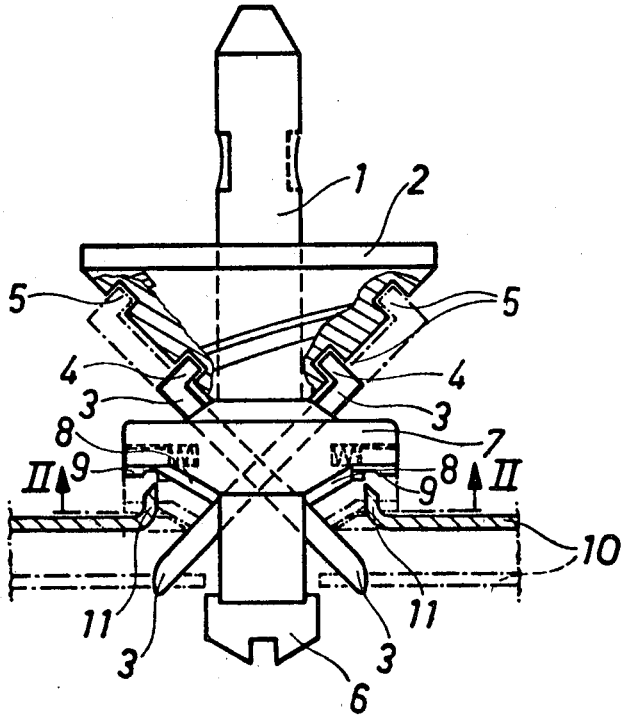
FIG. 1 is a schematic side view of a flange forming drill means of the invention.
Figure 2:
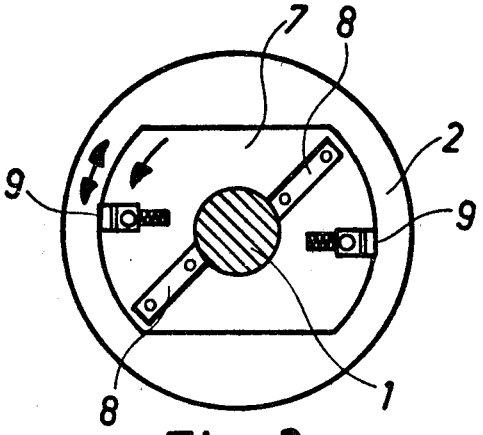
FIG. 2 is a section along the line II—II in FIG. 1.

The apparatus comprises a drill rod 1 to be mounted on a rotating machine and surrounded by a frusto-conical adjusting means 2. The adjustment cone 2 can be turned around the rod 1 and locked in various angular positions. Pin-shaped forming means 3 extend crosswise in the bores through the rod 1. The ends of forming means 3 are fitted with gripping means 4 which are slidably engaged in an adjustment groove 5 on the outer face of the adjustment cone 2, said groove pitching like a helix along the outer face of said cone. When the cone 2 is turned in either direction, the forming pins 3 move in such a manner that they either extend from the drill rod 1, as shown by the solid lines, or are retracted into the drill rod 1, as shown by the dot-dash lines.

To the lower end of the drill rod 1 is fitted a first bit 6 which can be either a fixed or replaceable drill bit. The drill rod 1 is further fitted with a drill body 7 whose lower face is provided with a second cutting bit whose bit elements 8 project radially on the opposite sides of the drill rod 1. The cutting edges of bit elements 8 are inclined upwards away from the rod 1. Thus, the cutting edges of bit elements 8 move along the frusto-conical face with the drill means rotating. To the drill body 7 is further fixed a third bit consisting of bit elements 9 which are disposed on the drill body 7 spaced from the rod 1 a distance equal to an outer radius of bit elements 8. The cutting edges **9*a* of bit elements 9 lie in a plane perpendicular to the drilling axis and the cutting edges 9*b*** are inclined.

The apparatus operates as follows. In the beginning the adjustment cone 2 is turned into a position where the ends of forming means 3 are retracted into the rod 1. At this stage, the initial hole is drilled in the pipe wall 10 by means of the bit 6. The drilling is then continued by means of bit elements 8, which produce an elliptical hole in the curved pipe wall. This is due to the fact that the intersection between the curved cylinder face and the conical face is elliptical. After the elliptical hole of desired size has been drilled, the cone 2 is turned, the forming pins 3 extending below the hole edges. Then the rotating drill means is pulled upwards, said forming pins 3 pulling up a flange 11 as shown in the pipe wall 10 in FIG. 1. Although the face of pipe 10 is curved, the outer edge of flange 11 will be brought up to substantially a common level, since the material rises more at the minor axis of the elliptical hole. Due to the bending of flange 11, the outer edge of the flange has moved radially outwards from the bit elements 8 to bit elements 9. Following this, the levelling of the flange outer edge can be effected by squeezing the bit elements 9 of the rotating drill means against the edge of the flange 11.

It can be appreciated that the flange can be completely made by means of one and the same drill means. It is obvious that, like the drill bit 6, the drill body 7 can also be made either fixed or removable and replaceable relative to the rod 1. Bit elements 8 and 9 suitably comprise bits that are fitted to the body removably and replaceably.

Figure 3:
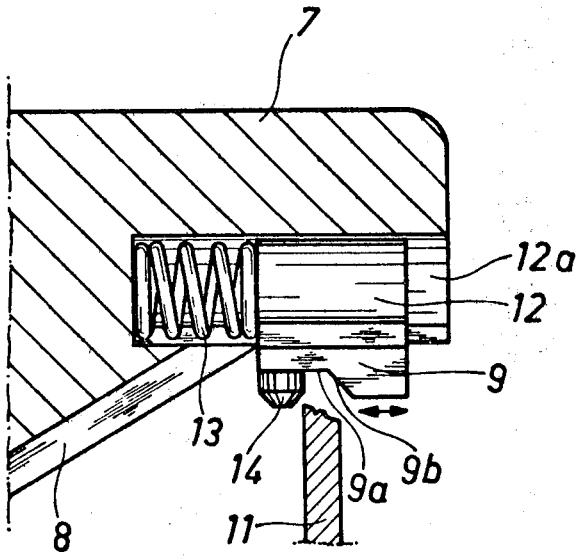
FIG. 3 is a partial section through a third or levelling bit in larger scale.

FIG. 3 shows a particularly preferred embodiment for the installation of bits 9 for levelling the edge of flange 11. A bit holder 12 is radially movable in a bore **12*a* made in the body 7 against the force of a spring 13**.

Spring 13 retains the holder 12 and the bit 9 fixed thereto in such a position that the edge of flange 11 hits the zone between a stud 14 and the inclined bit face 9*b*. The end of stud 14 is conical and the stud 14 can be made rotatable around the vertical axis, whereby it rotates against the inner face of flange 11 during the levelling operation of the edge. Thus, the flange 11 need not be exactly circular but the bit 9 follows the flange edge guided by the stud 14 and the inclined bit face 9*b*. At the same time, with increased flange wall thicknesses (as shown in FIG. 3), the bit face 9*b* bevels the end face of flange 11 for welding.

While there has been illustrated and described a single embodiment of the present invention, it will be apparent that various changes and modifications thereof will occur to those skilled in the art. It is intended in the amended claims to cover all such changes and modifications which fall within the true spirit and scope of the present invention.

What is claimed as new and designed to be secured by Letters Patent is:

1. A method of forming a flanged hole in a curved surface comprising the steps of:

forming an initail generally circular hole in said surface;

enlarging said initial hole into a larger oval hole with a conical cutting surface to form an edge surface of said hole of frusto conical shape;

turning the edge region around said enlarged oval hole outwardly to form a surrounding flange with a free outer edge lying substantially in a common plane; and shaping said outwardly turned free edge.

2. The method of claim 1 wherein said enlarging step includes the steps of drilling said oval hole using a cutting surface whose diameter increases as it extends away from its forward edge.

3. The method of claim 2 wherein said turning step includes the steps of extending a forming means beneath the edge region of said enlarged oval hole and pulling said forming means through said hole while said forming means rotates relative to said curved surface.

4. The method of claim 1 including the step of tapering said edge region.

* * * * *